United States Patent [19]

Jackle, III et al.

[11] Patent Number: 4,762,236

[45] Date of Patent: Aug. 9, 1988

[54] ADJUSTABLE TRAY DISPENSING APPARATUS

[75] Inventors: William C. Jackle, III, Scottdale, Ariz.; Richard A. Sherwood, Dallas, Tex.; Frederick M. Avery; James V. Seifert, both of Phoenix, Ariz.

[73] Assignee: The Niven Marketing Group, Des Plaines, Ill.

[21] Appl. No.: 68,153

[22] Filed: Jun. 29, 1987

Related U.S. Application Data

[63] Continuation-in-part of Ser. No. 920,042, Oct. 16, 1986, Pat. No. 4,730,741.

[51] Int. Cl.[4] ..... A47F 7/00

[52] U.S. Cl. ..... 211/59.3; 211/94.5

[58] Field of Search ..... 211/59.3, 59.2, 51, 211/43, 49.1, 94, 94.5; 312/45, 42, 15, 71; 206/556; 221/56, 226, 279

[56] References Cited

U.S. PATENT DOCUMENTS 3,308,961 3/1967 Chesley ..... 211/59.3

*Primary Examiner*—J. Franklin Foss
*Assistant Examiner*—Sarah A. Lechok Eley
*Attorney, Agent, or Firm*—Ralph R. Rath

[57] ABSTRACT

A product dispensing apparatus includes a support having a tray system supported thereon and the tray system includes front and rear walls interconnected by side walls and having a plurality of adjustable partitions extending between the front and rear walls to produce side-by-side trays. A guide member is located in each tray and slidably supports a pusher member which is biased toward the front wall. The support defines a stop to move all of the pusher members toward the rear wall when the tray system is moved from a product dispensing position to a product restocking position on the support.

25 Claims, 7 Drawing Sheets

FIG. 4
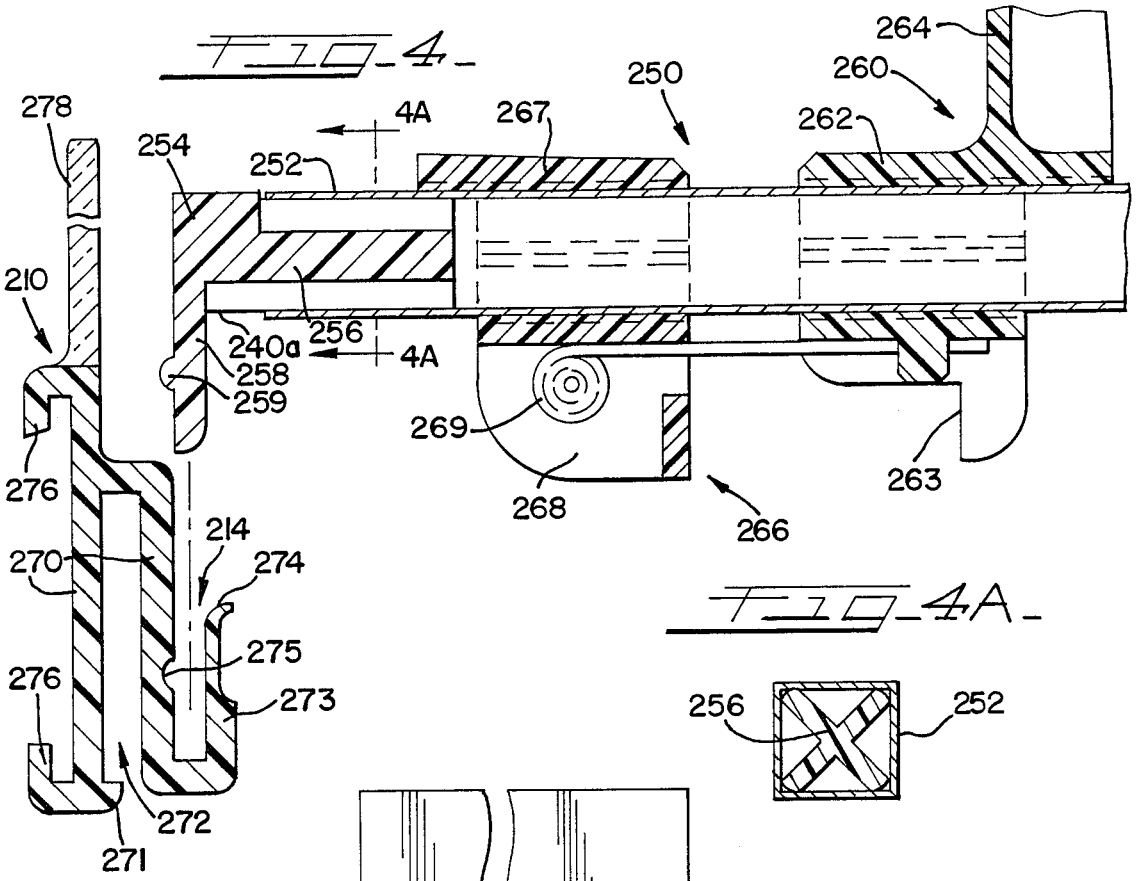
FIG. 4A
FIG. 5
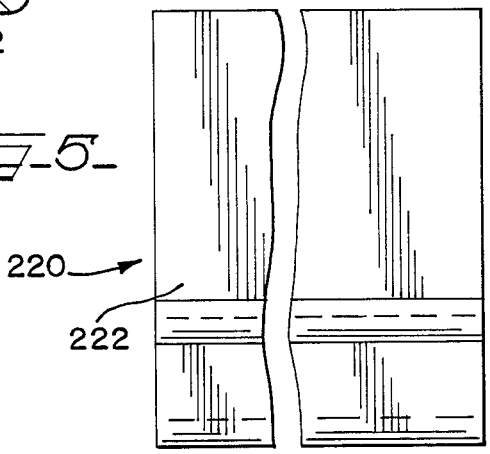
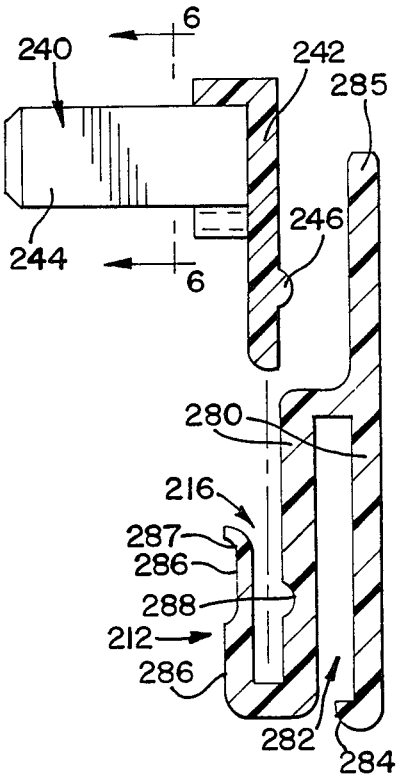
FIG. 6
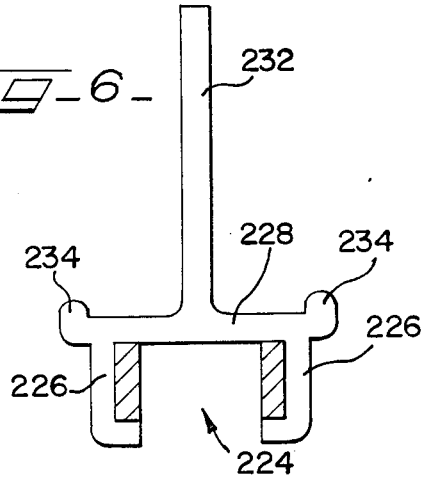

348
344
332
350
310
358
384
306
388
362
354
352
322
334
324
336
312
340
330
12
342
342a
360
345
346
308
309

ADJUSTABLE TRAY DISPENSING APPARATUS

REFERENCE TO RELATED APPLICATION

This application is a continuation-in-part application of U.S. Ser. No. 920,042, filed Oct. 16, 1986, now U.S. Pat. No. 4,730,741.

TECHNICAL FIELD

The present invention relates generally to dispensing devices and, more particularly, to a pressure-feed tray system which allows for easy access for restocking of the product with proper stock rotation.

BACKGROUND PRIOR ART

Shelving is used extensively for stocking various items for display at the point of purchase. For example, in grocery stores, fixed shelving is used extensively for supporting merchandise for display. In recent years, most stores have fixed shelving arranged in a back-to-back relation with a common rear wall so that the products are displayed towards aisles located on opposite sides of the shelving.

For many grocery products and other related items, the product is dated and usually is removed from the shelf after the expiration date for the particular product. Thus, in restocking of the product, it is necessary to place the new product or stock at the rear of the display so that the older product will be removed first via purchase. This usually involves the removal of the older stock and the replacement of new stock and subsequent replacement of the older stock, which is a time consuming operation. Also, most times in stores, there is no alternate space for storing the removed stock while the new stock is being placed on the shelves. Thus, many times the old stock is placed on the floor while the new stock is being replaced, which can create some health problems and is also an inconvenience to shoppers since the aisles may be cluttered with the product.

In order to devise a means for automatically moving the product to the front of the display, it has been proposed to use a gravity-feed type of stock supply in the shelving so that the new product can be inserted behind any existing product on the shelf. An example of such display and delivery stand is disclosed in U.S. Pat. No. 2,769,551. Such a system is acceptable if the product is relatively heavy so that it will automatically move towards the front of the display when an article is removed. However, if the product is light, such as in small snack foods or potato chips, gravity-feed is not very practical.

It has also been proposed to provide a biasing means which will automatically force the packages into an upright position at the front of the rack. For example, in the display of bags of potato chips, U.S. Pat. No. 3,008,583 discloses a device wherein the spring-biased follower automatically moves the stack of bags towards the front of the display. Such an arrangement has drawbacks in that the system requires a hook arrangement adjacent the rear of the display so that the follower can be moved and held to the rear of the display for restocking. However, access to the rear of the rack is seldom available in modern-day displays, particularly in grocery stores or other places.

SUMMARY OF THE INVENTION

According to the present invention, a pressure-feed tray system has been developed which can be moved from a product dispensing position to a product restocking position and wherein all of the pressure-feed members are automatically moved to the rear of the trays when the tray system is moved to a restocking position. Such rearward movement of the pressure members allows new stock to be positioned behind the existing older stock on the shelf, and the pressure-feed plates will automatically bias the stock towards the front of the tray when the tray system is returned to the display position.

More specifically, the product dispensing apparatus of the present invention includes a fixed support means and a tray slidably supported on the support means and movable from a product dispensing first position substantially coextensive with the support means to a second product replenishing position extending away from the support means. The tray has a front end and a rear end and guide means extending along the bottom portion of the tray between the front and rear ends. Pusher plates means are slidably mounted on the guide means and biased towards the front end with stop means on the support means for moving the pusher plate means to the rear end of the tray when the tray is moved from the dispensing position to the restocking position so that new stock can be introduced behind the existing stock in the tray.

In the preferred embodiment, the dispensing apparatus consists of front and rear walls having transverse slot means therein and interconnected by side walls. The tray system includes a plurality of partitions or dividers having projections at opposite ends received into the slot means and adjustable therein to produce a plurality of side-by-side trays that are adjustable in width. A guide member is centrally located along the bottom of each tray and has projections at opposite ends adjustably received into the slot means. A pusher plate member is slidably supported on each guide member and each member is individually biased toward the front wall by biasing means. The respective pusher plate members, thus, engage a rear-most product or article in each tray and bias all of the articles in the tray toward and into engagement with the front wall for display and will reposition the articles when the front article is removed.

The dispensing apparatus also incorporates a support for slidably supporting the tray system in either a product dispensing position or a product restocking position. The support includes a stop for simultaneously moving all of the pusher plate members toward the rear wall when the tray system is moved to the restocking position so that new products can be introduced behind the existing products without disturbing the existing products.

According to one aspect of the invention, the tray system is preferably fabricated from molded plastic parts that can be manufactured at minimimum cost and can easily be assembled while still accommodating small variations in dimensions of the respective parts. Thus, the guide members are in the form of hollow tubes, preferably rectangular in cross-section, that are open at opposite ends and telescopingly-receive inserts which have the projections thereon and will accommodate variations in spacing between the front and rear walls. Likewise, the partitions or dividers have sockets at opposite ends which receive inserts that have projections thereon to accommodate variations in spacing of the front and rear walls.

In the preferred embodiment, the pusher plate members include sockets that are slidably supported on the hollow tubes and the biasing means are coil springs supported in housings slidably supported on the tubes. The housing may, if desired, either abut against the front of the stop or abutment or may be secured or carried by the abutment.

In an alternate embodiment, the guide members slidably support the pressure plate members as well as the spring housings and can be supplied as an assembled subassembly. In this embodiment, the slot means are in the form of spaced rectangular openings that receive rectangular projections and the projections have lower offset free end portions to maintain an assembled condition.

In both embodiments, the biasing or spring means could be connected directly to the guide members or the stop and the separate spring, housings could be eliminated. Also, both embodiments incorporate latch means for maintaining the tray system in a product dispensing position.

BRIEF DESCRIPTION OF SEVERAL VIEWS OF DRAWINGS

FIG. 4 is an exploded fragmentary cross-sectional view, as viewed along line 4—4 of FIG. 2;

FIG. 4A is a cross-sectional view as viewed along line 4A—4A of FIG. 4;

FIG. 5 is an exploded fragmentary cross-sectional view, as viewed along line 5—5 of FIG. 3;

FIG. 6 is a cross-sectional view, as viewed along line 6—6 of FIG. 5;

DETAILED DESCRIPTION

Figure 1:
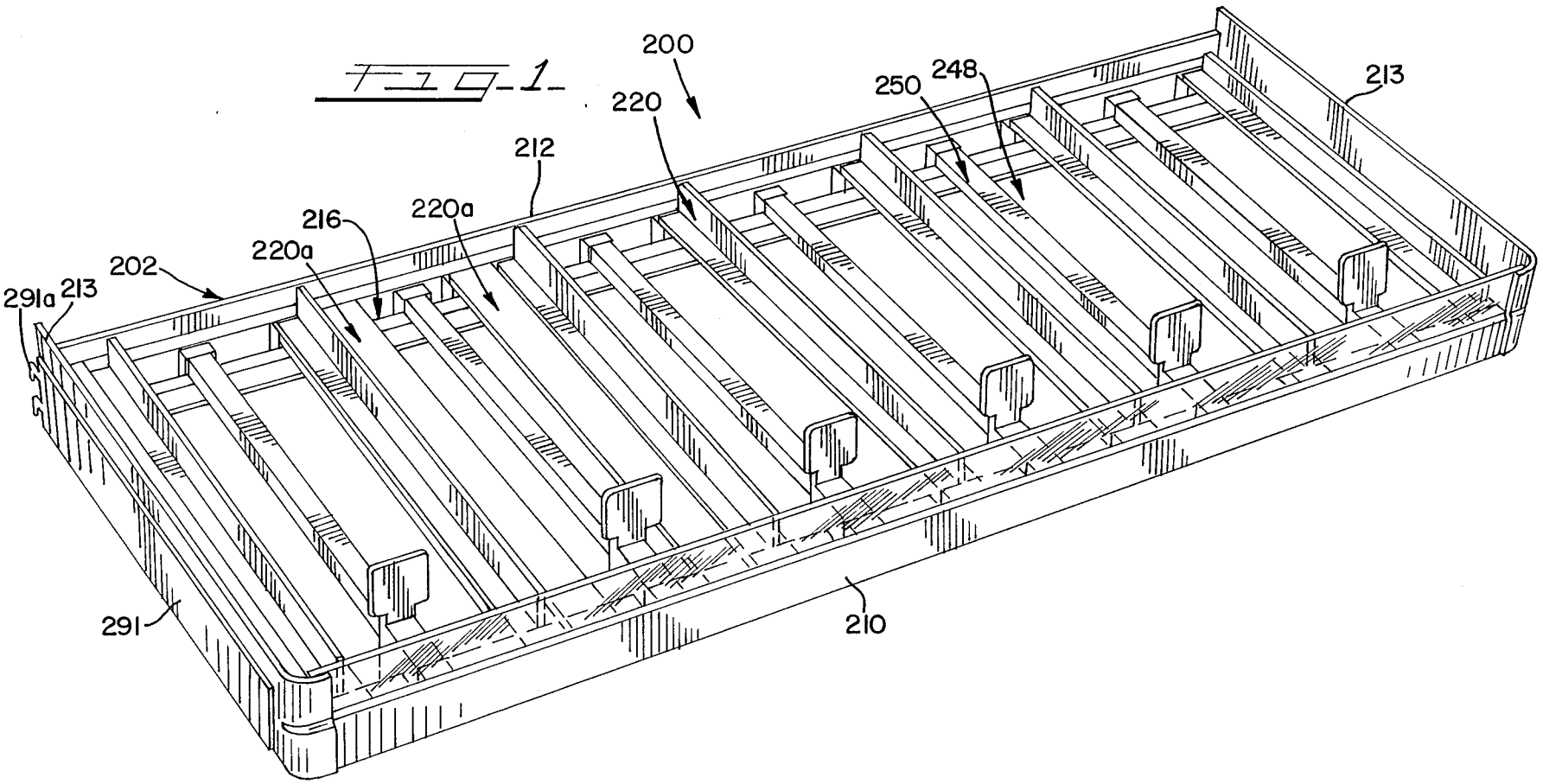
FIG. 1 is a perspective view of the preferred form of product dispensing apparatus constructed in accordance with the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
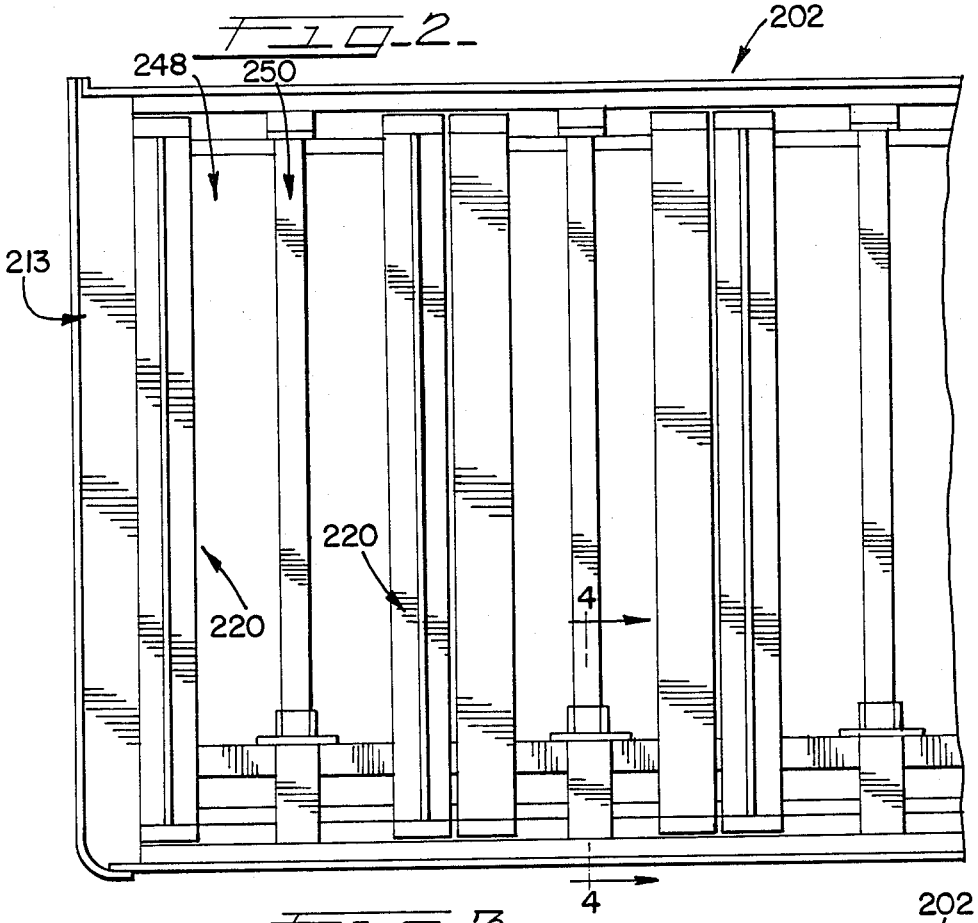
FIG. 2 is a fragmentary top plan view of the apparatus shown in FIG. 1.
Figure 3:
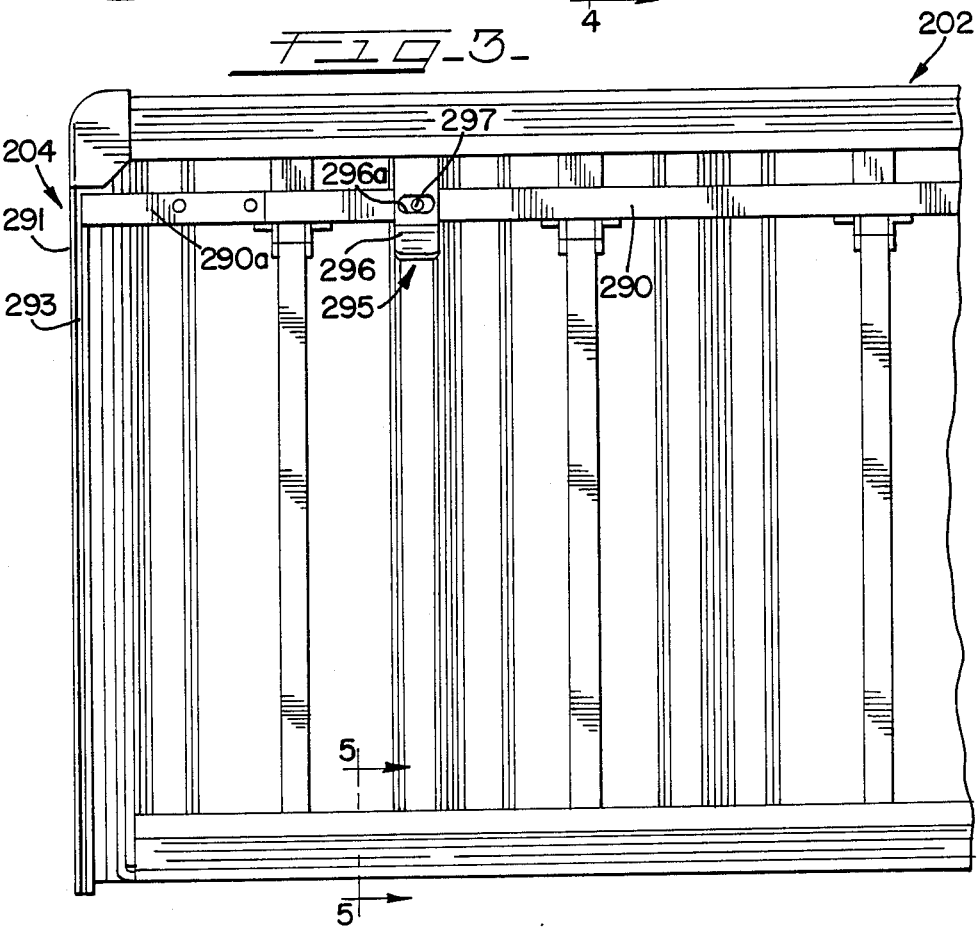
FIG. 3 is a fragmentary bottom plan view thereof.

FIGS. 1–9 disclose a product dispensing apparatus, generally designated by reference numeral 200, consisting of a tray system 202 that is supported on a support means 204 (FIG. 3). The dispensing apparatus disclosed in this embodiment is in many respects similar to the embodiment disclosed in FIGS. 21–30 of the above-mentioned U.S. Ser. No. 920,042, filed Oct. 16, 1986, and incorporated herein by reference.

The tray system 202 includes a front wall 210, a rear wall 212 and side walls 213 which are slidably supported on the support 204, as will be explained later. The front and rear walls 210 and 212 of the tray system 202 have upwardly-opening slot means 214 and 216 adjacent the inner wall surfaces thereof. The tray system 202 is divided into a plurality of individual side-by-side trays by a plurality of transversely-spaced partition means 220 that are illustrated in further detail in FIGS. 5 and 6. The partition means consist of an elongated member 222 that is preferably molded from a plastic material and has a lower socket portion 224 defined by a pair of downwardly-directed flanges 226 extending from a bottom wall 228 and inwardly-directed portions at the lower end thereof. A central divider 232 is integral with the bottom wall 228, which also has a pair of longitudinally-extending ribs 234 adjacent opposite edges thereof.

The socket 224 is open at opposite ends and telescopingly receives an insert 240 that has a downwardly-depending projection 242 integral therewith and a pair of transversely-spaced flanges 244 that are telescopingly received into the open ends of the socket 224, only one being shown in FIG. 5. The downwardly-depending projection 242 also has a longitudinal rib or detent 246, the purpose of which will be described later.

Thus, the partition 222 can be molded from a single piece of plastic material and the inserts 240 can be separately molded and telescoped into the opposite open ends of the socket 224 to thereby accommodate variations in spacing between the front and rear slot means 214 and 216, as will be explained later.

As illustrated in FIGS. 2 and 3, the partition means 220 divide the tray system 202 into a plurality of side-by-side trays 248, each of which has a pressure-feed mechanism 250 supported therein. The pressure-feed mechanism is illustrated in more detail in FIG. 4 and includes a hollow polygonal guide member or tube 252 that is open at both ends and has a pair of inserts 254 received into the opposite open ends thereof. The insert 254 consists of a main body that has an extension 256 that is in the form as a cross which is telescoped into the open end of the guide member or tube 252. The insert 254 also has a downwardly-depending projection 258 which has a longitudinally-extending rib or detent 259, the purpose of which will be described later.

The guide member 252 slidably supports a pusher plate means 260 consisting of a base 262 that defines a socket which telescopingly receives the tube or guide member 252. The base 262 has a lower abutment 263 and an upwardly-extending pusher plate 264 integral therewith. Preferably, the pusher plate means or member 260 is molded from a plastic material as a one-piece unit.

The pressure-feed mechanism 250 also incorporates a biasing means 266 that consists of a hollow socket 267 that is telescoped onto the tube 252 and has a lower spring housing 268 which supports a coil spring or biasing means 269. The free end of the coil spring 269 is fixedly secured to the base 262 in any desirable fashion (not shown).

Considering now the details of construction, the front wall 210 of FIG. 4 consists of a pair of spaced parallel walls 270 that define an elongated slot 272 which is partially closed at the lower end by a flange 271 and is designed to receive a reinforcing bar (not shown) to rigidify the front wall. A second wall 273 is located rearwardly of one of the walls 270 and extends upwardly to define the upwardly-opening slot means 214. The second wall 273 has an arcuate upper free edge 274 for guiding the projections 242 or 258 into the slot 214.

An arcuate recess 275 is spaced from the upper edge 274 of the second wall of the slot 214 by a dimension which is substantially equal to the spacing of the rib 246 from the upper edge of the projection 242. It will be noted that the upper end of the second wall 273 has a reduced thickness so as to be flexible to accommodate receipt of the projection, including the rib into the slot means 214.

The forward end of the front wall 270 has a pair of flanges 276 spaced therefrom and extending toward each other to define an elongated slot for the receipt of pricing information for the product. Also, the front wall 270 has an upwardly-directed extension 278, which is transparent so that the product can be viewed therethrough. The extension 278 is preferably molded simultaneously with the remainder of the front wall 210 but of a different material.

The rear wall 212 is substantially identical in construction as the front wall 210 with the exception of the second slot for the pricing information. Thus, as shown in FIG. 5, the rear wall includes first and second parallel spaced walls 280 that define an elongated slot 282, the lower end of which is partially closed by a flange portion 284 extending from one of the walls 280. The slot receives a reinforcing bar (not shown). The rear-most wall 280 has an upwardly-directed extension 285 which defines the majority of the rear wall. A second wall 286 is spaced from the forward-most parallel wall 280 and has a reduced thickness portion **286*a* at the upper end thereof which terminates in an arcuate upper edge 287 to define the rear-most elongated slot means 216. The wall 280 has an elongated recess 288 which is positioned to receive either projection 242, 258 and the rib 246 or 259**.

Figure 8:
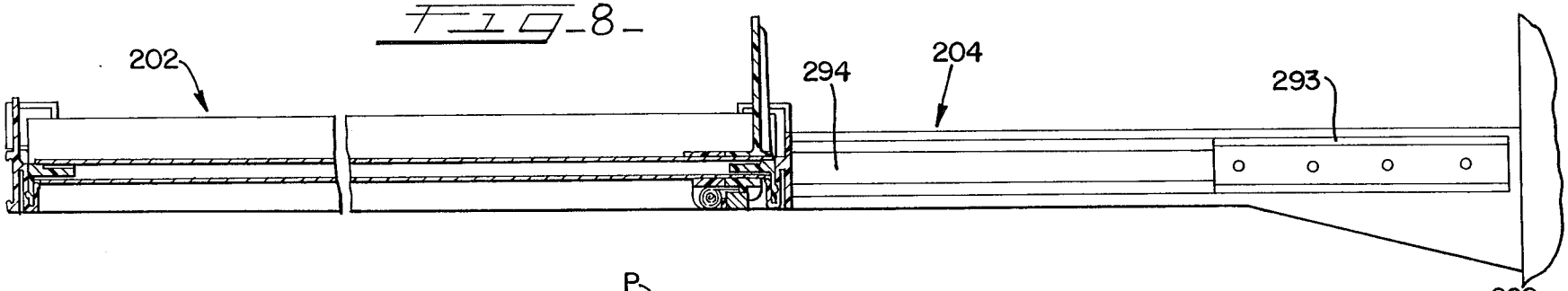
Figure 9:
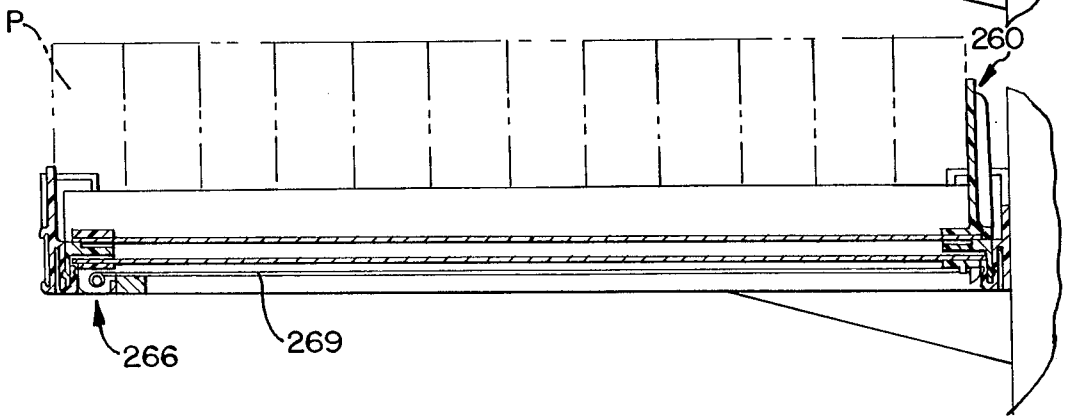

Before discussing the assembly and operation of the unique tray dispensing system, the details of the support structure will be described with reference to FIGS. 7, 8 and 9. As illustrated therein, the support means 204 consists of a rectangular cross-bar 290 that is connected by extensions **290*a* (FIG. 3) to a pair of support plates 291 extending rearwardly from opposite ends thereof to define a C-shaped structure. Support plates 291 have hooks 291*a* at the rear ends (FIG. 1) which are attached to a support structure 292, such as a gondola structure. The support plates 291 extend substantially parallel to the side walls 213 and each have a rail 293 affixed thereto. The respective side walls 213 likewise have a corresponding rail (not shown) secured thereto and an intermediate rail 294** is slidably supported between the two rails. This structure is disclosed in more detail in the above-mentioned application.

A latch means 295 is located between support 204 and tray system 200. Thus, as shown in FIG. 3, the front wall 202 has a flexible latch plate 296 having an opening **296*a* extending therefrom and overlapping cross-bar 290. A projection or latch pin 297 extends from the lower surface of bar 290 and is aligned with opening 296*a***.

The assembly and operation of the unique pressure-feed tray system will now be described. Initially all of the various parts that form the tray assembly are molded from a plastic material, such as a high-impact styrene, and each of the components of the tray system is designed such that each part can be molded in a single-step molding process. Thereafter, the side walls are telescopingly assembled to opposite ends of the front and rear walls in a suitable manner (not shown) and metal rails are attached to the outer surfaces of the side walls.

The tray frame is then assembled onto the support 204 and two inserts 240 are inserted into the opposite ends of the socket 224 defined on the partition means 220. It will be noted that the configuration of the extension 256 is such that there is no rotational movement of the insert on the tube. The projections 242 of the inserts 240 are then inserted into the front and rear slots 214 and 216 and are guided by the arcuate upper edges 274 and 287. When the projections 242 are seated in the bottom of the slots, the ribs or detents 246 are received into the recesses 275 and 288. Since the inserts are freely slidable in the open ends of the socket 224, the inserts will assume a position that will accommodate any variations in spacing between the front and rear slots.

It should be noted that the ribs 246, 259 and the position of the recesses 275 and 288 are such that the lower edge **240*a* of the insert 240 provides a frictional grip along the upper edge 274 and 287** of the slot means to thereby prevent any transverse shifting of the inserts within the slot means. If desired, separate rubber elements may be provided to define the frictional grip.

Of course, it will be appreciated that the positioning of the partition means is infinitely variable so that any width of tray may be introduced into the tray system. Preferably, the partition means 220 are positioned such that the divider 232 defines a common wall between two adjacent trays, and the bottom wall 228 of two adjacent partitions defines a partial floor for each of the trays. The respective ribs 234 define a limited sliding contact area with the product that is being dispensed to reduce the frictional forces.

After all of the trays have been defined in the tray system, a pressure-feed mechanism 250 is positioned in the center of the bottom of each of the trays 248 and is equally spaced from the two adjacent ribs 234. In assembling the pressure-feed mechanism 250, a pusher member 260 is initially telescoped onto the guide member 252, which may be formed of metal or plastic material. A biasing mechanism 266 is likewise telescoped onto the guide member or tube 252, while the free end of the coil spring is attached to the pusher member 260. The respective inserts 254 are then inserted into the opposite open ends of the tube 252.

In certain instances, a product may have a significant width so that the partial bottom walls 228 and ribs 234 may not be sufficient to adequately support the product. To alleviate this problem, partial bottom walls **220*a* (FIG. 1) may be used between the dividers 232 and the guide bars 252. Partial bottom wall members 220*a* are configured substantially identical to members 220 (FIG. 6) except for the elimination of the dividers 232 and are supported by separate inserts 240**.

Figure 7:
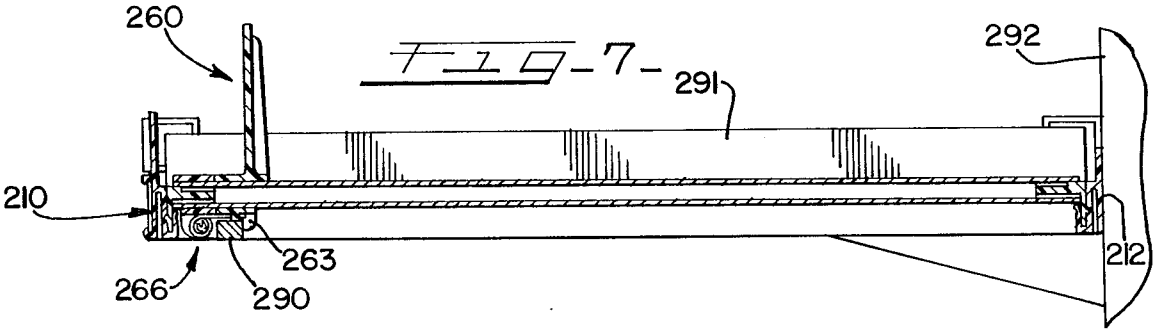
FIGS. 7, 8 and 9 show cross-sectional views of the product dispensing apparatus in various positions.

In assembling the pressure-feed mechanisms 250 onto the tray system, each biasing mechanism 256 is located between the cross bar 290 and the front wall 210, while each pusher means or member 260 is located between the cross-bar 290 and the rear wall 212, as clearly shown in FIG. 7.

Thus, in the assembled condition, the spring biasing means, i.e., the coil spring 269, will bias the pusher means 260 towards the cross-bar 290 and the biasing means 266 will be restrained from rearward movement by the crossbar. The abutment 263 will engage the rear surface of the cross-bar when there is no product in the tray 248. This position is illustrated in FIG. 7 wherein the tray system is in a product dispensing position with respect to the support 204 without product therein.

When it is desired to stock the tray system with products, the latch mechanism 295 or a latch mechanism, such as disclosed in copending application Ser. No. 920,042, is released and the tray system is moved from the dispensing position (shown in FIG. 7) to the restocking position (shown in FIG. 8). During this forward movement of the tray system to a position forwardly on the support means 204, the pusher means 260, as well as the spring-biasing means 266, will remain in the position illustrated in FIG. 7 and will slide towards the rear of the tray system 202 until the tray system is in the fully-extended product restocking position illustrated in FIG. 8. Thus, all of the pressure plate means or pusher means 260 are moved towards the rear wall when the tray system is in the product restocking position. During this movement, any products that are in the trays will remain adjacent the forward wall, thus allowing new product to be introduced behind the existing product without disturbing the existing product.

After all of the trays have been filled with new product P, the tray system is returned to its product dispensing position (FIG. 9), and during such movement, each pusher means 260 engages the rear-most product in each tray and remains in engagement therewith so that all of the products in a particular tray are forced towards the front wall while the coil spring 269 is extended. Therefore, the product is forced into engagement with the front wall, particularly the upwardly-directed extension 278 which is preferably formed of a transparent plastic material so that the face of the product is in clear view of the purchaser.

Thereafter, when an item or product is removed from the front of the tray, the pusher means 260 will automatically move the remainder of the product into engagement with the front wall. It should be noted that during this forward movement, only limited contact is made between the product and the transversely-spaced ribs 234 to reduce the frictional forces required to be overcome and insure that the product in each tray is always located at the forward end thereof.

As mentioned above, the coil springs could be attached directly to the cross-bar 290 or alternatively could be connected directly to the front ends of the guide bars 252. However, the disadvantages of this arrangement is that the force of all of the springs must be overcome when the tray system is moved to the restocking position.

A slightly modified form of the invention is disclosed in FIGS. 10–16 and is in many respects similar to the embodiment previously disclosed. Thus, the product dispensing apparatus 300 (FIG. 10) consists of a tray system 302 supported on a support 304 (FIG. 16) that consists of a cross-bar 306 having side plates 308 extending rearwardly from opposite ends thereof. The frame structure 304, to be described later, is substantially similar to the frame structure described in the first embodiment and the rearwardly-extending support plates 308 have hooks 309 (FIG. 14) for supporting the entire assembly on a fixed support, such as a gondola structure.

Figure 15:
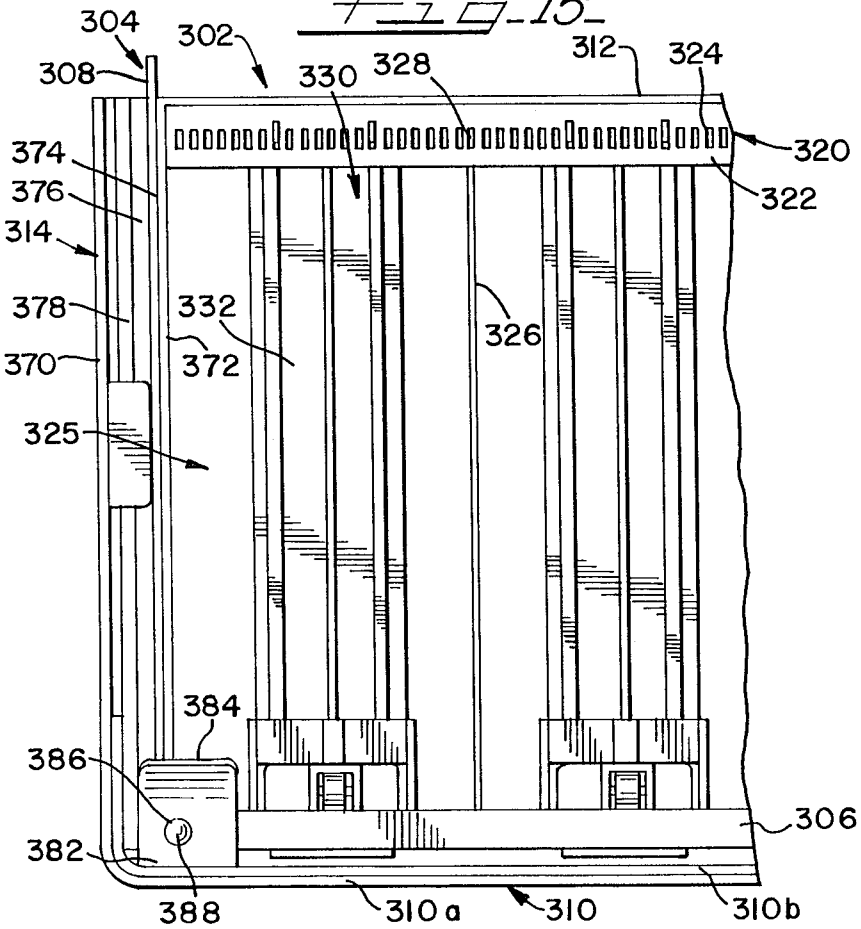
FIG. 15 is a fragmentary bottom view showing the apparatus in the product dispensing position; and, FIG. 16 is a view similar to FIG. 15 showing the apparatus in a product restocking position.

The tray system 302 incorporates front and rear walls 310 and 312 that are interconnected by side walls 314. As illustrated in FIG. 15, the side walls 314 define an integral part of the front wall 310 and the front wall 310 includes first and second plates **310*a* and 310*b* in juxaposed position to each other. As in the previous embodiment, the front and rear walls 310 and 312 have slot means 320 (FIG. 15) defined adjacent the inner surface thereof. In the specific embodiment illustrated, the front and rear walls have inwardly-directed flanges 322 (FIGS. 11, 15) that have a plurality of substantially rectangular openings or apertures 324**.

Figure 10:
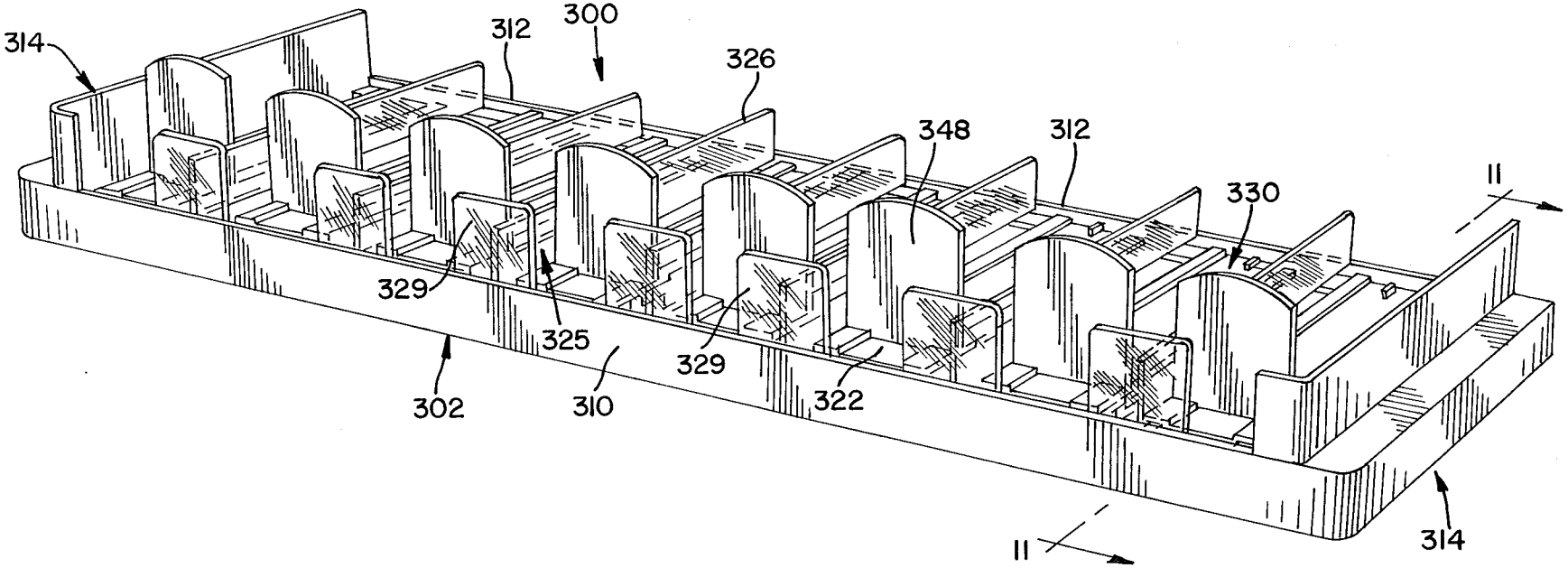
FIG. 10 is a perspective view of a modified form of product dispensing apparatus.

The tray system 302 including the front, rear and side walls 310, 312, 314 is divided into a plurality of individual side-by-side trays 325 by partitions or dividers 326 that have projections 328 at opposite ends thereof respectively received into the openings 324. The dividers 326 have transparent front wall portions 329, as shown in FIG. 10. Of course, it will be appreciated that the width of the respective trays is substantially infinitely variable by proper selection of the pairs of aligned openings 324 in which the projections 328 are received.

A pressure-feed mechanism 330 is located in and defines a partial bottom wall for each of the trays defined by respective pairs of partitions 326. The pressure-feed mechanism 330 consists of an elongated guide member 332 (FIGS. 11, 12) that has first and second transversely-spaced pairs of projections 334 at opposite ends thereof. The respective projections 334 are received into respective pairs of openings 324 and have lower offset end portions 336, for a purpose to be described later.

The pressure-feed mechanism 330 also includes a pusher means or member 340 that is slidably supported on the guide member 332. In the embodiment illustrated, the guide member 332 has a pair of upper outwardly-directed flanges 342 that define a first pair of guide tracks. Each pusher means 340 includes a base 344 that has inwardly-opening slots 346 that receive the guide tracks 342. The pusher means also includes an upwardly-directed pusher plate 348, for a purpose that will be described later.

Figures 11, 12, 13, 14:
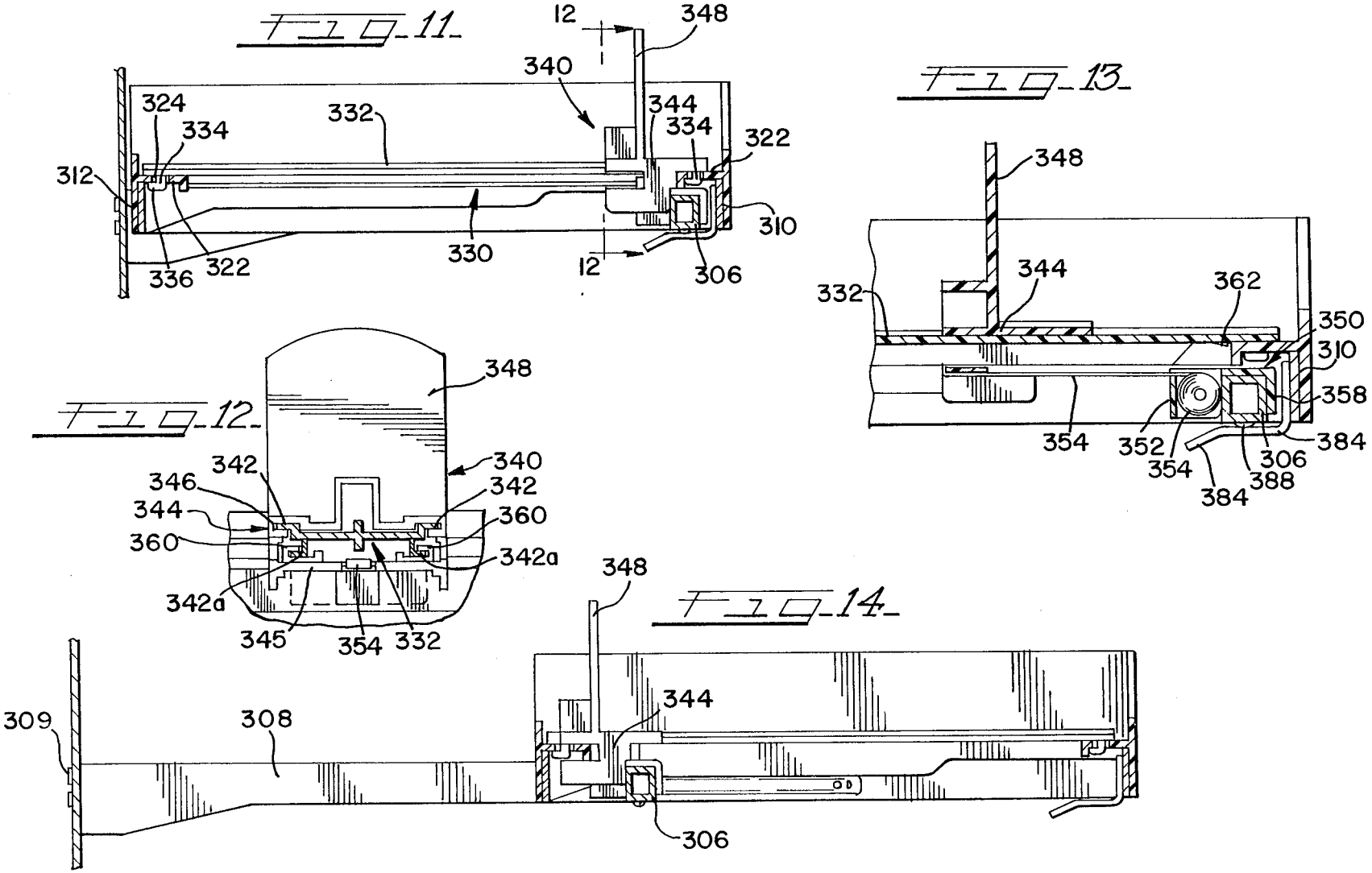
FIG. 11 is a cross-sectional view, as viewed along line 11—11 of FIG. 10.
FIG. 12 is a view as viewed along line 12—12 of FIG. 11.
FIG. 13 is an enlarged fragmentary cross-sectional view of the apparatus shown in FIG. 11.
FIG. 14 is a view similar to FIG. 11 showing the apparatus in a product restocking position.

The pusher means 340 is biased towards the front wall 310 through biasing means, illustrated in FIGS. 12 and 13. The biasing means consist of a member 350 that has a downwardly-extending housing 352 which supports a coil spring 354, the free end of which is connected to the base 344 of the pusher means 340. For this purpose, base 344 has a lower interconnecting cross-brace 345 (FIG. 12) which has an opening (not shown) that receives the free end of the spring 354.

The biasing means also has a downwardly-directed flange 358 spaced from the housing 352 and cooperating therewith to define a downwardly-opening slot that has a width substantially equal to the width of the cross-bar 306 so as to be telescoped thereon and restrained for movement by the cross-bar. The biasing means also incorporates a pair of flanges 360 that define slots for receiving a second pair of guide tracks **342*a* defined adjacent the lower portion of the guide member 332. The biasing mechanism is restrained for movement by the cross-bar 306 and biases the pusher means 340 towards the front wall 310, as shown in FIG. 11**.

As indicated above, the projections 334 extend from the lower surface of the guide member 332 and have offset end portions 336. The offset end portions extend in the same direction below the flanges 322. A detent 362 (FIG. 13) on guide member 332 engages an inner edge of flange 322. Since the guide member is formed of plastic material, the detent can be cut out from the floor of the guide member and the plastic memory will normally retain it in the position illustrated, but can be deflected upwardly to remove the guide member. Thus, the offsets 336 are first inserted into openings 324 and manipulated under the flanges while the projections are located in the openings 324. The detent 362 will move after it clears the adjacent flange to lock the guide member 332 in position (FIG. 13).

Figure 16:
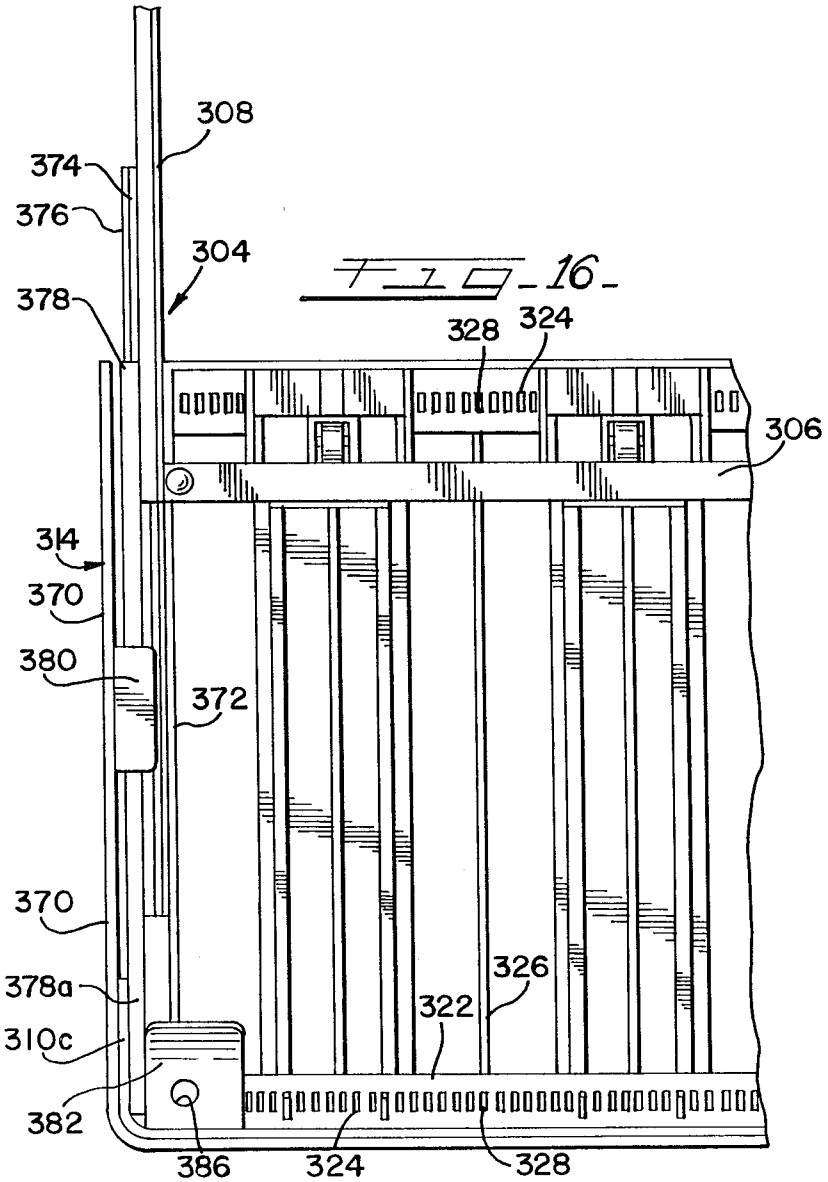

As in the previous embodiment, the tray system 302 is designed to be moved from a product dispensing position (FIGS. 10, 11 and 15) to a product restocking position (FIGS. 14 and 16). For this purpose, the support means 304 and the tray system 302 have cooperating guide means which will be described in connection with FIGS. 15 and 16. As illustrated therein, the side walls 314 consist of an outer wall 370 and an inner wall 372 that have a space therebetween. The rearwardly-directed support plates 308 are located in the space, juxtaposed to inner wall 372 and have a fixed track 374 secured thereto. The track 374 slidably receives a floating track segment 376 which is also slidably supported on a track 378 secured to outer wall 370.

It will be noted in FIG. 16 that the outer wall 370 is integral with front plate 310*a* of front wall 310 while front plate 310*b* has an extension 310*c* which extends partially along the outer wall 370 and is fixedly secured thereto. The track 378 has its forward end 378*a* fixedly secured to the inner surface of the extension of the extension 310*c*, as shown in FIG. 16. The remainder of the track is suspended between the two walls 370 and 372 and is free to move laterally therein. Guide plates 380 are fixed to the outer wall 370 and extend inwardly below the guide rails 378, 376 to prevent the guide rails from deflecting downwardly. Thus, the tracks 376, 378 can laterally deflect to accommodate slight variation in misalignment of the tracks 376, 378 and side plate 308.

The tray system 300 disclosed in FIGS. 10–16 also incorporates a latch mechanism for maintaining the tray system in a dispensing position on the support frame. Thus, as shown in FIGS. 15 and 16, a cantilevered plate 382 extends rearwardly adjacent the bottom of the front wall 310 and has a downwardly-inclined tapered portion 384 on the free end thereof. The plate has an opening 386 therein and the lower surface of the cross-bar 306 has a substantially circular button 388 secured thereto which is adapted to be received into the opening 386. While only one such latch has been shown, it will appreciated that two separate latches are located adjacent the opposite corners of the tray system disclosed in FIG. 16.

The tray system is initially assembled to produce the desired number of trays separated by the partitions or dividers 326 and a pressure-feed mechanism 330 is then assembled in the center of each of the respective trays.

The operation of the dispensing apparatus disclosed in FIGS. 10–16 is in many respects similar to that described above, but will be summarized briefly for purposes of completeness. Thus, the tray system is normally in its product dispensing position (FIGS. 11 and 15) wherein all of the pusher plates means 340 are biased toward the front wall into engagement with the cross-bar 306 when there is no product in the respective trays, as shown in FIG. 11. The tray system 302 is maintained in this dispensing position by the latch mechanism 382, described above.

When it is desired to restock the system with new products, the two latches 382 are released and the tray system is pulled forward from the position shown in FIG. 15 to the position shown in FIGS. 14 and 16. In this forward movement of the tray system, the bases 344 of the pusher means 340 will engage the cross-bar 306 which will simultaneously move all of the pusher plate means 340 towards the rear wall to the position shown in FIG. 14, while being guided by the tracks 342. At the same time, the biasing member 350 is guided on the lower tracks 342*a* of guide members 332 to provide a partial support for the tray system on the cross-bar 306 and minimize the load of the tray system on the tracks 374, 376, 378.

In this position, the upwardly-open trays are exposed for ready stocking of products into the respective trays. Each of the trays is then stocked with product (not shown), which is supported on the spaced flanges 342. The tray system is returned to its product dispensing position (FIG. 10) and the pressure plates 348 will be biased into engagement with the rear-most product in a tray and will force all of the products towards the front wall.

It will be appreciated that the product dispensing apparatus of the present invention is extremely versatile and can be constructed and configured to display products of varying size and configuration in side-by-side relation. Of course, various modifications come to mind without departing from the spirit of the invention. For example, the pressure-feed mechanisms could be changed significantly in construction and configuration so long as they are biased to the front of the tray system and are moved to the rear wall for restocking purposes. Also, the partitions or dividers could assume any configuration and the bottoms of the trays could be formed as completely separate pieces, if desired.

While specific embodiments have been illustrated and described, numerous modifications come to mind without significantly departing from the spirit of the invention and the scope of protection is only limited by the scope of the accompanying claims.

We claim:

1. A product dispensing apparatus comprising a tray system including a front wall, a rear wall and interconnecting side walls at opposite ends of said front and rear walls; support means including a cross-bar extending between said side walls and having support plates at opposite ends thereof in juxaposed relation to said side walls with rail means between said side walls and said support plates for guiding said tray system between a rear product dispensing position wherein said support plates and said side walls are substantially coextensive and a product restocking position where said tray system is located forward of said support means, said tray system including a plurality of partitions extending between said front and rear walls and releasably retained thereon to define a plurality of transversely-spaced trays, guide means extending between said front and rear walls in each of said trays, pusher means slideably supported on said guide means, and biasing means between said cross-bar and each of said pusher means for maintaining engagement with a rear-most product in a tray to move all products in a tray toward said front wall when the tray system is in a product dispensing position and accommodating movement of said pusher means toward said rear wall when said tray system is moved to said product dispensing position so that new products can be introduced behind existing products in a tray.

2. A product dispensing apparatus as defined in claim 1, in which said front and rear walls have slot means and said partitions and guide means have securing means received into said slot means.

3. A product dispensing apparatus as defined in claim 2, in which said slot means are continuous upwardly-open slots adjacent an inner surface of said front and rear walls and said securing means include projections at opposite ends of said guide means and said partitions.

4. A product dispensing apparatus as defined in claim 3, in which said slots are defined by second walls spaced inwardly of said inner surfaces, said second walls having free upper edges with recesses in said slots spaced from said upper edges, said projections having detents received into said recesses.

5. A product dispensing apparatus as defined in claim 4, in which said guide means and said partitions have means providing a frictional grip with said upper edges to maintain the guide means and partitions in adjusted positions.

6. A product dispensing apparatus as defined in claim 1, in which said partitions each define a common wall for two adjacent trays.

7. A product dispensing apparatus as defined in claim 2, in which each guide means includes a hollow member open at opposite ends with inserts telescoped into said opposite ends and having projections received into said slot means.

8. A product dispensing apparatus as defined in claim 1, further including latch means between said tray system and support means for maintaining said tray system in said product dispensing position on said support means.

9. A product dispensing apparatus as defined in claim 2, in which said slot means includes a plurality of spaced apertures along said front and rear walls with said guide means including an elongated member having projections received into said apertures.

10. A product dispensing apparatus as defined in claim 9, in which said front and rear wall have inwardly-directed flanges extending toward each other and have said apertures therein and in which said projections have offet portions on free ends thereof directed toward one of said front and rear walls and means on said elongated member engaging one of said flanges to maintain said projections in said apertures.

11. A product dispensing apparatus as defined in claim 9, in which said elongated member has a first pair of guide tracks slidably supporting said pusher means and a second pair of guide tracks with a cradle structure slidably supported thereon and restrained by said cross-bar, said biasing means being supported on said cradle structure to bias said pusher means toward said cross-bar.

12. A tray system for a product dispensing apparatus comprising spaced front and rear walls interconnected by side walls at opposite ends thereof, said front and rear walls having slot means along an inner surface thereof; a plurality of elongated partitions respectively having projection means at opposite ends thereof received into said slot means to produce a plurality of side-by-side trays between said side walls, said partitions being transversely adjustable to vary the width of said trays; a guide member in each of said trays and having projection means at opposite ends received into said slot means; a pusher member slidably supported on each of said guide means with separate biasing means biasing each pusher member toward said front wall, each pusher member having a feed plate engaging an adjacent product in a tray and moving all products in the tray toward said front wall; and means for substantially simultaneously moving all of said pusher members toward said rear wall when said tray system is positioned for restocking so that existing products will remain adjacent said front wall in each tray and new products can be inserted behind existing products.

13. A tray system as defined in claim 12, further comprising support means including a cross-bar extending below said tray between said side walls and having support plates at opposite ends adjacent said side walls with rail means between said support plates and said side walls to accommodate movement of said tray system between a product dispensing position and a product restocking position with said cross-bar being adjacent said front wall in said product dispensing position and defining said last means for moving said pusher means toward said rear wall when said tray system is moved to said product restocking position.

14. A tray system as defined in claim 13, in which each biasing means includes a coil spring restrained from rearward movement by said cross-bar and having a free end connected to a pusher means.

15. A tray system as defined in claims 12, 13 or 14, in which said front and rear walls have inwardly-directed flanges having generally rectangular openings defining said slot means and said projection means include generally rectangular projections received into said openings and means on at least said guide members for releasably retaining said projections in said openings.

16. A tray system as defined in claims 12, 13 or 14, in which each guide means includes an elongated body having at least two transversely-spaced projections at each end and having first and second pairs of guide tracks thereon with said pusher means supported on said first pair of guide tracks and a cradle for each coil spring carried by said cross-bar and slidably supported on said second pair of guide tracks.

17. A tray system as defined in claims 12, 13 or 14, in which each guide member and partition includes a hollow member having opposite open ends with inserts telescoped into said open ends and having said projection means thereon.

18. A tray system as defined in claim 17, in which said slot means are continuous upwardly-opening slots adjacent said front and rear walls so that said partitions and guide members are infinitely adjustable with respect to said front and rear walls.

19. A tray system as defined in claim 17, in which each biasing means includes a housing slidably supported on a guide member and having a coil spring thereon with a free end thereof connected to said pusher member.

20. A pressure-feed dispensing apparatus comprising a generally C-shaped support including a cross-bar having a pair of support plates at opposite ends, a tray frame including front and rear walls and side walls with said front and rear walls having upwardly-opening slot means, track means between said support plates and said side walls for slidably supporting said tray frame between a product dispensing position where said cross-bar is adjacent said front wall and a product restocking position where said cross-bar is adjacent said rear wall, a plurality of transversely-spaced partitions having projection means at opposite ends received into said slot means to define a plurality of side-by-side trays, a guide member in each of said trays and having projection means at each end received into said slot means with means for releasably retaining said projection means in said slot means, a pressure feed means slidably supported on each guide member, and biasing means for independently biasing each pressure feed means toward said front wall so that products in a tray will be biased toward said front wall when said tray frame is in said product dispensing position, said cross-bar engaging all of said pressure means when said tray frame is moved to said product restocking position to move said pressure means toward said rear wall and accommodate restocking of new products behind existing products while said trays are exposed forward of said support.

21. A pressure-feed dispensing apparatus as defined in claim 20, in which said slot means are continuous slots adjacent an inner surface of said front and rear walls and in which said guide member includes a hollow polygonal tube open at both ends with an insert telescoped into each end and having said projection means thereon to thereby accommodate variations in spacing between said front and rear walls.

22. A pressure-feed dispensing apparatus as defined in claim 21, in which each pressure means includes a socket slidably supported on said polygonal tube between said rear wall and said cross-bar and each biasing means includes a socket having a housing thereon supporting a coil spring having a free end connected to a pressure means with each biasing socket slidably supported on said polygonal tube between said front wall and said cross-bar.

23. A pressure-feed dispensing apparatus as defined in claim 20, in which each guide member has a first pair of guide tracks with said pressure-feed means slidably supported thereon and a second pair of guide tracks, said biasing means including a housing slidably supported on said second pair of guide tracks and being constrained for movement by said cross-bar.

24. A pressure-feed dispensing apparatus as defined in claim 23, in which said slot means includes a plurality of transversely-spaced openings adjacent said front and rear walls with said projection means including projections of a corresponding size received into said openings.

25. A pressure-feed dispensing apparatus as defined in claim 24, in which each guide member has a pair of transversely-spaced projections at opposite ends with said projections having offset end portions, said guide members having detent means for locking said projections in said openings with said offset end portions.

* * * * *